United States Patent [19]

Oka

[11] 4,436,413

[45] Mar. 13, 1984

[54] MAGNETIC BRUSH DEVELOPING APPARATUS

[75] Inventor: Tateki Oka, Toyokawa, Japan

[73] Assignee: Minolta Camera Kabushiki Kaisha, Osaka, Japan

[21] Appl. No.: 413,724

[22] Filed: Sep. 1, 1982

[30] Foreign Application Priority Data

Sep. 11, 1981 [JP] Japan ..... 56-145650

[51] Int. Cl.[3] ..... G03G 15/08

[52] U.S. Cl. ..... 355/15; 355/3 DD; 355/14 D; 430/122; 430/125; 118/652; 118/657; 118/658

[58] Field of Search ..... 355/15, 3 DD, 14 D; 118/652, 657, 658; 430/122, 125

[56] References Cited

U.S. PATENT DOCUMENTS

| | | | |
|---|---|---|---|
| 3,816,157 | 11/1974 | Donohue et al. | 355/15 X |
| 3,917,397 | 11/1975 | Tanaka et al. | 355/15 |
| 4,190,351 | 2/1980 | Macaluso et al. | 355/15 |
| 4,205,911 | 6/1980 | Dole | 355/15 |
| 4,319,832 | 3/1982 | Sakamoto et al. | 355/15 |
| 4,361,397 | 11/1982 | Katakura et al. | 355/15 |
| 4,385,829 | 5/1983 | Nakahata et al. | 355/3 DD |
| 4,392,735 | 7/1983 | Oka | 355/3 DD |

FOREIGN PATENT DOCUMENTS 56-74284 6/1981 Japan .

*Primary Examiner*—A. C. Prescott

*Attorney, Agent, or Firm*—Wenderoth, Lind & Ponack

[57] ABSTRACT

A magnetic brush developing apparatus has a developing sleeve made of a nonmagnetic material, a magnetic roller rotatably mounted within the developing sleeve, a magnetic developer supply device to supply developer to the peripheral surface of the developing sleeve, a drive connected to the magnetic roller for rotating the magnetic roller to transport the supplied developer along the peripheral surface of the developing sleeve, and a developer scraping member made of a nonmagnetic material and having a free end engaged with the developing sleeve for scraping developer off the peripheral surface of the developing sleeve and guiding the developer along a guide surface on the scraping member in a direction away from the surface of the developing sleeve. A foreign material separating member made of a magnetic material is disposed within a region which is subject to the magnetic action of the magnetic roller and having an edge spaced from and opposed to the guide surface around which an alternating magnetic field is set up when the magnetic roller is rotated, whereby the alternating magnetic field agitates the developer being guided along the guide surface for separating foreign material from the developer scraped off the peripheral surface of the developing sleeve.

7 Claims, 3 Drawing Figures

MAGNETIC BRUSH DEVELOPING APPARATUS

BACKGROUND OF THE INVENTION

The present invention relates to a magnetic brush developing apparatus, and more particularly to a magnetic brush developing apparatus provided with means for separating from a magnetic developer in the apparatus foreign materials which cause various troubles during operation of the apparatus.

The magnetic developers heretofore known for use in magnetic brush developing apparatus include single-component developers consisting only of a magnetic toner, two-component developers comprising an insulating toner and a magnetic carrier admixed therewith, and composite developers comprising a mixture of several kinds of toners including a magnetic toner. Such a developer is used for developing latent electrostatic images on an image bearing surface into visible images while being circulated within the magnetic brush developing apparatus. As the developer is repeatedly circulated for a long period of time, more and more foreign materials become mingled with and accumulate in the developer.

Typical of such foreign materials are agglomerates of developer gradually formed during the repeated circulation of the developer from toner particles which are subjected to physical forces or heat during the circulation and which are thereby joined with one another, the agglomerates usually having about 10 times the diameter of the toner particles, and fibers of copy paper which become incorporated in the developer in a progressively increasing amount and which generally have a length nearly 10 times the diameter of the toner particles. Fibers of copy paper become incorporated in the developer especially markedly in a magnetic brush developing apparatus for transfer-type electrophotographic copiers in which the developer remaining on the surface of the photoconductive member is recovered for reuse after the transfer of the toner image.

In a transfer-type electrophotographic copier or the like, such foreign materials, if present in large quantities in the developer, cause various troubles, such as impaired transportability of the developer itself, uneven density in developed images and blank portions in transferred image areas. In a magnetic brush developing apparatus, therefore, it is very important to prevent the foreign materials from accumulating in the developer.

SUMMARY OF THE INVENTION

The main object of the present invention is to provide a novel and useful magnetic brush developing apparatus.

Another object of the invention is to provide a magnetic brush developing apparatus having the function of continually separating foreign materials from the developer.

Another object of the invention is to provide a magnetic brush developing apparatus equipped with means having a simple construction for separating foreign materials from the developer.

These and other objects of the invention are achieved by a magnetic brush developing apparatus according to the invention and comprising a developing sleeve made of a nonmagnetic material, a magnetic roller rotatably provided within the developing sleeve, means for supplying a magnetic developer onto the peripheral surface of the developing sleeve, drive means for rotating the magnetic roller to transport the supplied developer along the peripheral surface of the developing sleeve, a developer scraping member made of a nonmagnetic material for scraping the transported developer off the peripheral surface of the developing sleeve and guiding the developer along a guide surface in a direction away from the sleeve surface, and a foreign material separating member made of a magnetic material and disposed within a region which is subjected to the magnetic action of the magnetic roller for separating foreign material from the developer scraped off the peripheral surface of the developing sleeve by the action of an alternating magnetic field set up at the edge of the separating member close to the magnetic roller when the magnetic roller is rotated.

The foregoing material separating member is made of a magnetic metal plate and disposed with one edge directed toward the magnetic roller. The separating member is opposed to the guide surface of the scraping member and positioned at a sufficient distance away from the peripheral surface of the developing sleeve. The edge of the separating member which is closer to the magnetic roller is positioned within a free space in which the developer is freely movable, and the developer is freely agitated by the action of the alternating magnetic field. A foreign material collecting container is provided in the vicinity of the separating member. The developing sleeve is rotatable and is drivingly rotated in timed relation with the rotation of the magnetic roller in the same direction as the magnetic roller.

These and other objects, advantages and features of the invention will become apparent from the following description thereof taken in conjuction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE INVENTION

Figure 1:
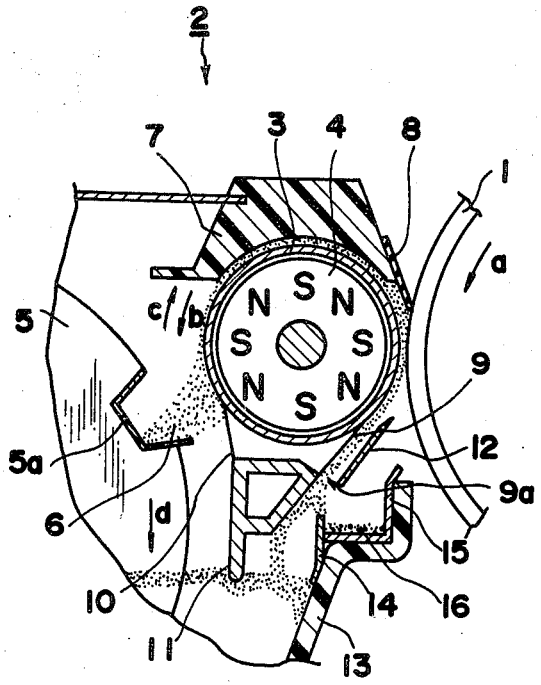
FIG. 1 is a fragmentary view showing the internal construction of a magnetic brush developing apparatus according to the invention.

FIG. 1 is a view showing a magnetic brush developing apparatus according to the invention and incorporated in a transfer-type electrophotographic copying machine.

As shown in FIG. 1, an electrophotographic photoconductive drum 1 of the copying machine is rotatable in the direction of arrow a while carrying on its surface a latent electrostatic image formed by an unillustrated process. During the rotation of the drum 1, the latent image is developed into a visible image by the magnetic brush developing apparatus 2. In the present embodiment, the latent electrostatic image is adapted to have a negative polarity.

The developing apparatus 2 has a developing sleeve 3 opposed to the surface of the drum 1 and a magnetic roller 4 rotatably provided within the sleeve 3. The developing sleeve 3 is made of aluminum, stainless steel or like nonmagnetic material and has a diameter of 31 mm. According to the present embodiment, the developing sleeve 3 is rotatably mounted and preferably rotated at a speed of 30 r.p.m. in the direction of arrow b by an unillustrated drive means. On the other hand, the magnetic roller 4 is in the form of a roll having S and N poles arranged alternately along its periphery and is preferably driven at a speed of 1300 r.p.m. by the unillustrated drive means in the direction of arrow b, i.e. in the same direction of rotation as the sleeve 3. Consequently a magnetic developer 6 supplied by a bucket roller 5 onto the peripheral surface of the developing sleeve 3 is subjected to a transport force exerted by the rotation of the sleeve 3 in the direction of arrow b while being subjected to a transport force exerted by the rotation of the magnetic roller 4 in the direction opposite to the arrow b relative to the peripheral surface of the sleeve 3. As a result, the developer is transported in the direction of arrow c along the peripheral surface of the developing sleeve 3.

The bucket roller 5 comprises a plurality of buckets 5*a* provided between and supported by two rotary disks. When the bucket roller 5 is rotated in the direction of arrow d, the developer 6 accommodated in the tank 13 to be described later is partly scooped up in the buckets 5*a* and supplied onto the peripheral surface of the developing sleeve 3. According to the present embodiment, the developer 6 preferably 90 wt. % of a magnetic carrier of small particle size and 10 wt. % of an insulating toner admixed therewith by stirring. By being brought into contact with the carrier, the toner is triboelectrically charged positively, i.e. to a polarity opposite to the polarity of the latent electrostatic image. More specifically, the carrier comprises fine magnetic particles dispersed in a resin and has a mean particle size of 20 to 25 μm and a resistivity of $10^{14}$ ohm-cm. The insulating toner is nonmagnetic and has a mean particle size of 10 to 15 μm.

An upper casing 7 of resin is provided above the developing sleeve 3 and has a inner peripheral surface with the cross-sectional shape of an arc and which is spaced from the peripheral surface of the sleeve 3 a specified distance. While being transported along the periphery of the sleeve 3, the developer 6 comes into light brushing contact with the peripheral surface of the casing 7. The casing 7 has a seal 8 of polyurethane film attached to the end thereof opposed to the drum 1. The seal 8 has one end lightly pressed against the surface of the drum 1 and a surface facing the sleeve 3 and positioned approximately on an extension of the circular-arc shaped inner peripheral surface of the casing 7.

A scraper 9 and a cleaner 10 are arranged under the developing sleeve 3. The scraper 9 has a free end in contact with the sleeve 3 and extending generally in the direction of rotation of the sleeve 3, i.e. in the same direction as the arrow b. The cleaner 10 has a free end in contact with the sleeve 3 and extending generally in a direction opposite to the arrow b. The developer 6 passing through the developing region, i.e. the region where the sleeve 3 is opposed to the drum 1 at a small distance therefrom, and transported along the sleeve surface in the direction of arrow c is scraped off the sleeve surface by the scraper 9 and is further guided by the scraper 9 along a guide surface 9*a* thereof in a direction away from the sleeve surface. The scraper 9 is made of a thin plate of nonmagnetic material, e.g. a thin phosphor bronze plate preferably having a thickness of 50 μm. Of the developer 6 supplied to the peripheral surface of the sleeve 3 by the bucket roller 5, the excess, i.e. the amount of developer 6 moving with the rotation of the sleeve 3 in the direction of arrow b without being subjected to the magnetic action of the magnetic roller 4, is scraped off the sleeve surface by the cleaner 10. The cleaner 10 is made of a thin plate of phosphor bronze preferably having a thickness of 100 μm. The other ends of the scraper 9 and the cleaner 10 are fixed to a support member 11 of a nonmagnetic material, e.g. aluminum. The scraper 9 and the cleaner 10 have their free ends pressed against the peripheral surface of the sleeve 3 due to their being warped themselves.

In the vicinity of the forward free end portion of the scraper 9, there is positioned a nonmagnetic plate 12 for preventing the developer from scattering, the plate 12 being at a definite distance from the scraper 9 and in a position opposed to the edge of the end of the scraper end. The preventing plate 12 physically and electrically inhibits the scattering of developer 6 that can occur when the developer 6 is scraped off the peripheral surface of the sleeve 3. The plate 12 is made of an electroconductive material and is electrically grounded.

A foreign material separating plate 14 is fixed to the developer tank 13 at a position within a region subjected to the magnetic action of the magnetic roller 4. The separating plate 14 is opposed to the guide surface 9*a* of the scraper 9 and has one edge directed towards the magnetic roller 4. The plate 14 is made of a magnetic material, e.g. iron and preferably has a thickness of 1 mm. The distance l1 between the forward edge of the separating plate 14 and the guide surface 9*a* is about 4 mm so as to make sure that the separating plate 14 is out of direct contact with the portion of developer 6 being guided along the guide surface 9*a*, and the distance l2 between the forward edge of the separating plate 14 and the peripheral surface of the developing sleeve 3 is about 12 mm. As a result, the separating plate 14 is positioned a sufficient distance away from the periphery of the developing sleeve 3. When thus positioned, the separating plate 14, although present, will not increase the rotational torque of the magnetic roller substantially, and the magnetic roller 4, despite its high-speed rotation, will not exert any great vibrating force of the separating plate 14. In the present embodiment wherein the magnetic roller 4 preferably exerts a magnetic force of 1000 gauss on the peripheral surface of the developing sleeve 3, it has been found desirable to make the distance l2 from 10 to 20 mm. This matches the condition in which a magnetic field of about 50 gauss is set up in the vicinity of the forward edge of the separating plate 14.

Figure 2:
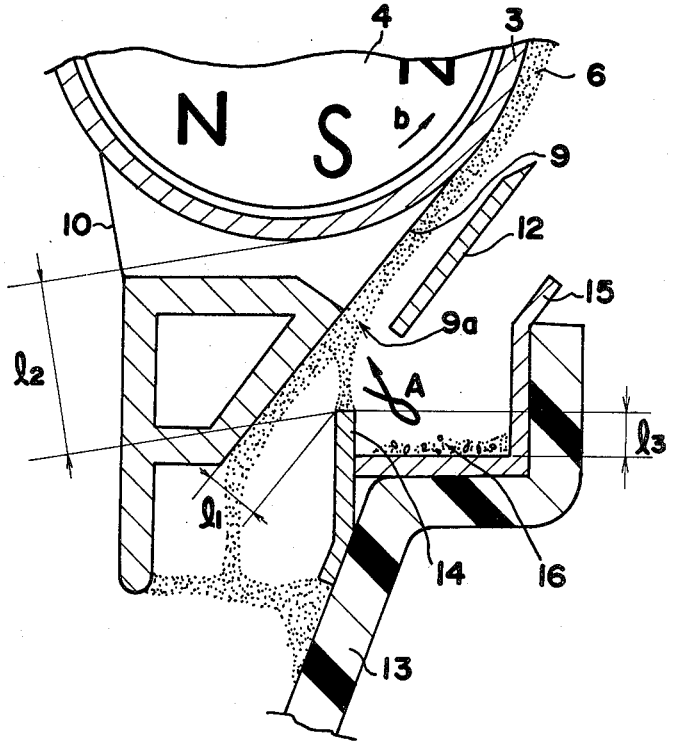
FIG. 2 is an enlarged view showing the main portion of FIG. 1.

Because the separating plate 14 is made of a magnetic material and provided within a region subjected to the magnetic action of the magnetic roller 4, the magnetic action of the roller 4 magnetizes the plate 14 itself, setting up a magnetic field in the vicinity of the forward edge of the separating plate 14. Because the scraper 9 extends across the space between the sleeve 3 and the separating plate 14, the magnetic field is formed across the guide path for the developer 6 along the guide surface 9*a* of the scraper 9. When the magnetic roller 4 is in the position of FIG. 2, a portion of the developer 6 being guided along the scraper guide surface 9*a* is magnetically attracted in the form of a brush to the forward edge of the separating plate 14 by the action of the magnetic field thus set up as shown in FIG. 2. Since the forward edge of the separating plate 14 is located within a free space, the developer 6 thus magnetically attracted in the form of a brush is greatly agitated as indicated by the arrow A in FIG. 2 by being acted on by the alternating magnetic field set up in the vicinity of the forward edge of the separating plate 14 by the rotation of the magnetic roller 4 in the direction of arrow b. More specifically the developer is returned onto the guide surface 9*a* and further guided leftwardly downward in FIG. 2 along the guide surface 9*a*. The brush-like portion of developer 6 magnetically attracted to the forward edge of the separating plate 14 is continually replaced by a fresh portion of developer 6 guided along the guide surface 9*a*. When the portion of developer 6 agitated in this way contains a particle of foreign material 16, the particle of foreign material 16 is scattered toward the right side of the separating plate 14 in FIG. 2, falls under gravity and is collected in a collecting container 15 provided close to the separating plate 14. The container 15 is made of a nonmagnetic material, e.g. aluminum. In the present embodiment, a predetermined bias voltage is applied to the container 15 to electrically prevent developer dust 6 from escaping through the space between the end of the developer tank 13 and the surface of the drum 1.

For convenience, the separating plate 14 itself constitutes part of the container 15 according to the present embodiment, whereas the collecting container 15 may be formed separately from the separating plate 14 and be removable from the developer tank 13. This provides convenience in removing and discarding the foreign material 16 collected in the container 15. While the entire separating plate 14 as shown is made of a magnetic material, it is possible to make only the forward edge portion thereof of a magnetic material and to make the other portion formed of a nonmagnetic material.

It has further been found that the depth l3 of the container 15, in other words, the distance l3 from the forward edge of the separating plate 14 to the bottom surface of the container 15, is preferably about 3 mm. Experiments conducted with the present embodiment with varying dimensions of l3 have shown that the container 15 fails to collect foreign particles 16 therein effectively when the distance l3 is less than 2 mm, and permits ingress of some developer 6 thereinto if the distance exceeds 5 mm. However, the optimum value of the distance l3 varies greatly with the kind of developer 6 used, etc., so that the above-mentioned value is most suitable only insofar as the present embodiment is concerned.

The behavior of the developer 6 in the present embodiment will be described generally.

While the magnetic brush developing apparatus 2 is in operation, the developer 6 supplied onto the peripheral surface of the developing sleeve 3 by the bucket roller 5 is transported along the sleeve surface in the direction of arrow c by the rotation of the magnetic roller 4. When passing through the developing region during such transport, the developer comes into brushing contact with the surface of the photoconductive drum 1. If the drum 1 has a latent electrostatic image formed on its surface, the developer develops the image to a visible image. The developer 6 passing through the developing region is further transported in the direction of arrow c thereafter being scraped off the surface of the sleeve 3 by the scraper 9 and guided along the guide surface 9*a* away from the sleeve surface.

While thus being guided along the guide surface 9*a*, the developer 6 is magnetically attracted to the forward edge of the separating plate 14 and is also greatly agitated as indicated by the arrow A in FIG. 2. Consequently foreign particles 16, such as fibers of copy paper which themselves are not magnetic or agglomerates of developer, are scattered rightward in FIG. 2, fall under the effect of gravity and collect in the container 15. In the case of the developer 6 of the type used in the present embodiment, toner particles charged to a polarity not suited to development, i.e. those negatively charged to the same polarity as the latent electrostatic image, or toner particles which are not sufficiently charged with a positive polarity to be attracted to the magnetic carrier, are therefore collected in the container 15 in the same manner as the foreign particles 16. Thus developer 6 composed only of the toner particles fully charged to the polarity suited for development and carrier particles will return onto the guide surface 9*a*.

Subsequently the portion of developer 6 agitated as described above and from which the foreign particles and agglomerates 16 have been separated and which has returned onto the guide surface 9*a* is further guided along the guide surface 9*a*, falls of the guide surface 9*a* in a region which is subjected to substantially no magnetic action of the magnetic roller 4, and is collected in the developer tank 13 so it can be supplied again onto the peripheral surface of the sleeve 3 by the bucket roller 5.

This is a general description of the behavior of the developer 6 in the present embodiment.

An experiment was carried out involving making 60,000 copies of A4 size using a transfer-type electrophotographic copying machine having incorporated therein the present embodiment of the invention, namely, the magnetic brush developing apparatus 2. Although the developer remaining on the photoconductive drum after the transfer of every toner image was recovered and reused for development, the operation caused no troubles, such as impaired transportability of the developer itself, uneven density in the developed images and blank portions in the transferred image areas. The developer was found to be substantially free from any foreign material. During the experiment, about 2 g of foreign particles were separated and collected per 10,000 copies.

Another copying experiment was carried out in the same manner as described above, except that the separating plate 14 of the magnetic brush developing apparatus 2 was replaced by a nonmagnetic plate of stainless steel. During this experiment, uneven density, blank portions, etc. became gradually apparent in copy images after making about 5,000 copies. During the experiment, substantially nothing was collected in the collecting container 15.

Figure 3:
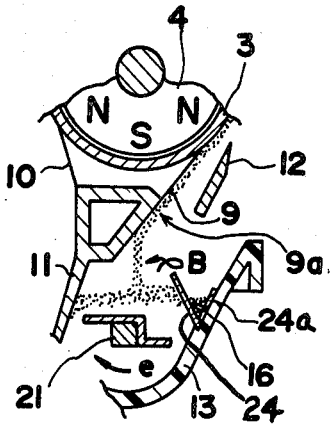
FIG. 3 is a view showing a modification of the embodiment of FIGS. 1 and 2.

FIG. 3 shows a modification of the embodiment of FIGS. 1 and 2. A foreign material separating plate 24 is provided which constitutes the front wall of a V-shaped cross-section container 24*a* removably mounted on the wall of the developer tank 13. The foreign material separating plate 24 of this modification has a forward edge which is at a distance of 9 mm from the guide surface 9*a* of a scraper 9, so that the developer 6 being guided along the guide surface 9*a* will not be agitated by the action of an alternating magnetic field set up in the vicinity of the forward edge of plate 24. In this modification, foreign particles 16 are separated and collected in the following manner. A rotary blade 21 rotatable in the direction of arrow e is provided in the vicinity of the separating plate 24, and blade 21 is rotatably driven by driving means (not shown) which may be part of the driving means for the developing apparatus, and also the top level of the developer 6 within the developer tank 13 is positioned slightly below the forward edge of the separating plate 24. The portion of developer 6 scraped off the peripheral surface of the developing sleeve 3 is guided along the guide surface 9*a*, falls into the developer tank 13 and is guided to a location close to the forward edge of the separating plate 24 by the rotation of the rotary blade 21. At this location, the developer portion is greatly agitated by the action of the alternating magnetic field as indicated by an arrow B, whereby the foreign material 16 is separated and collected in the same manner as in the previously described embodiment.

Briefly, the magnetic brush developing apparatus of this invention agitates the developer scraped off the developing sleeve by subjecting it to the action of an alternating magnetic field set up in the vicinity of a separating member. This effectively and continually separates foreign particles from the developer, consequently eliminating the likelihood that the foreign material will accumulate in the developer. The means for separating the foreign material ingeniously utilizes the magnetic action and rotation of the magnetic roller and has a simple construction because the separating member is substantially the only member that is additionally provided. Incidentally, when the developer used is a two-component developer composed of an insulating toner and a magnetic carrier in mixture, the toner particles which are not charged suitably for development are also separated conjointly with the foreign material.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A magnetic brush developing apparatus comprising a developing sleeve made of a nonmagnetic material, a magnetic roller rotatably mounted within said developing sleeve, means for supplying a magnetic developer onto the peripheral surface of said developing sleeve, drive means connected to said magnetic roller for rotating said magnetic roller to transport the supplied developer along the peripheral surface of said developing sleeve, a developer scraping member made of a nonmagnetic material and having a free end engaged with said developing sleeve for scraping developer off the peripheral surface of said developing sleeve and guiding the developer along a guide surface on said scraping member in a direction away from the surface of said developing sleeve, and a foreign material separating member made of a magnetic material and disposed within a region which is subject to the magnetic action of said magnetic roller and having an edge opposed to said magnetic roller around which an alternating magnetic field is set up when the magnetic roller is rotated, whereby said alternating magnetic field agitates the developer which is scraped off the peripheral surface of the developing sleeve for separating foreign material therefrom.

2. A magnetic brush developing apparatus as claimed in claim 1 wherein said foreign material separating member is a magnetic metal plate and is positioned with one edge thereof directed toward the magnetic roller.

3. A magnetic brush developing apparatus as claimed in claim 2 wherein said separating member is opposed to the guide surface of the scraping member and positioned at a distance from said guide surface sufficient for said edge to be out of direct contact with said magnetic developer moving along said guide surface.

4. A magnetic brush developing apparatus as claimed in claim 3 wherein said edge of said separating member is positioned within a free space adjacent the developer moving along said guide surface and close enough to said guide surface for the developer to be freely agitated by the action of the alternating magnetic field.

5. A magnetic brush developing apparatus as claimed in claim 1, further comprising a foreign material collecting container provided in the vicinity of the separating member.

6. A magnetic brush developing apparatus as claimed in claim 1 wherein said developing sleeve is rotatable and is drivingly rotated in timed relation with the rotation of said magnetic roller in the same direction as the magnetic roller.

7. A magnetic brush developing apparatus as claimed in claim 3 in which said edge of said separating member is spaced from said guide surface a distance sufficient to prevent said developer moving along said guide surface from being agitated by said alternating magnetic field, and further comprising a means adjacent said edge for causing developer fallen from said guide surface to be guided into said alternating magnetic field.

* * * * *

UNITED STATES PATENT AND TRADEMARK OFFICE

CERTIFICATE OF CORRECTION

PATENT NO. : 4,436,413

DATED : March 13, 1984

INVENTOR(S) : Tateki OKA

It is certified that error appears in the above—identified patent and that said Letters Patent is hereby corrected as shown below:

On the title page, Item [30] "56-145650" should read -- 56/135650--.

Signed and Sealed this

Tenth Day of July 1984

[SEAL]

*Attest:*

GERALD J. MOSSINGHOFF

*Attesting Officer*

*Commissioner of Patents and Trademarks*